US005545071A

United States Patent [19]

Shiraishi

[11] Patent Number: 5,545,071

[45] Date of Patent: Aug. 13, 1996

[54] EDUCATIONAL TOY KEYBOARD

[75] Inventor: Masami Shiraishi, Tiba, Japan

[73] Assignees: Stuff Co., Ltd.; Works Co., Ltd., both of Tokyo, Japan

[21] Appl. No.: 403,947

[22] Filed: Mar. 14, 1995

[30] Foreign Application Priority Data

Mar. 15, 1994 [JP] Japan ..... 6-004186 U

[51] Int. Cl.[6] ..... A63H 33/30; A63H 33/40

[52] U.S. Cl. ..... 446/143; 446/408; 446/179

[58] Field of Search ..... 446/143, 176, 446/178, 179, 199, 213, 397, 404, 408, 483, 487, 489

[56] References Cited

U.S. PATENT DOCUMENTS

| | | | |
|---|---|---|---|
| 1,429,382 | 9/1922 | Vaughan | 446/323 |
| 2,383,305 | 8/1945 | Greene | 446/143 |
| 2,571,405 | 10/1951 | Anthony | 446/487 |
| 2,788,697 | 4/1957 | Anthony | 446/143 X |
| 3,159,935 | 12/1964 | Rubens | 446/199 X |
| 4,250,657 | 2/1981 | Barlow et al. | 446/178 |
| 5,145,447 | 9/1992 | Goldfarb | 446/408 |

*Primary Examiner*—Robert A. Hafer
*Assistant Examiner*—D. Neal Muir
*Attorney, Agent, or Firm*—Oblon, Spivak, McClelland, Maier, & Neustadt, P.C.

[57] ABSTRACT

An educational toy keyboard is constructed of a main body, keys arranged on the main body, and transparent cylinders corresponding to the individual keys. The transparent cylinders are mounted on the main body and tone-indicating characterful figures are fitted for flotation within the respective cylinders. The tone-indicating characterful figures are floated by buoyancy of compressed air. The keyboard further includes a blower for feeding the compressed air, and a sound-generating circuit capable of sounding a scale or melody in response to depression of the individual keys. When the individual keys are selectively depressed, the sound-generating circuit sounds the scale or melody and the tone-indicating characterful figures are caused to float in the corresponding transparent cylinders.

4 Claims, 3 Drawing Sheets

EDUCATIONAL TOY KEYBOARD

BACKGROUND OF THE INVENTION

1. Field of the Invention

This invention relates to an educational toy keyboard, and especially to an educational toy keyboard designed to visually express a scale, namely, a graduated series of musical tones by tone-indicating characterful figures, for example, characterful dolls arranged for flotation in corresponding transparent cylinders in response to depression of corresponding keys in the keyboard. This educational toy keyboard therefore makes it possible to selectively play melodies so that it can attract an infant's interests and can also make the infant have interests in a scale and melodies.

2. Description of the Related Art

Educational toys designed to sound a scale or melody via a sound-generating circuit in response to selective depression of a keyboard or a keyboard image showed at a display area have been developed to date. Further, expensive educational toys designed to sound a melody by giving key selecting instructions in accordance with a preset program have also been developed conventionally.

These conventional educational toys are effective for those having intellectual cognitive faculties improved to certain extent but cannot be used comfortably and/or effectively by low-age infants. In addition, they require a relatively high degree of skill so that low-age infants tend to become tired or weary of playing them. Moreover, the toys of the latter type themselves are extremely expensive.

SUMMARY OF THE INVENTION

With the foregoing in view, the present invention has as a primary object the provision of an educational toy keyboard in which tone-indicating characterful figures such as dolls are floated within corresponding transparent cylinders by selective depression of the keyboard by a low-age infant, thereby attracting his or her attention to the keyboard and arousing his or her interests in the scale and melodies.

In one aspect of the present invention, there is thus provided an educational toy keyboard comprising:

a main body, keys arranged on the main body, transparent cylinders corresponding to the individual keys, said transparent cylinders being mounted on the main body, tone-indicating characterful figures fitted for flotation within the respective cylinders, said tone-indicating characterful figures being floated by buoyancy of compressed air, means for feeding the compressed air, and a sound-generating circuit capable of sounding a scale or melody in response to depression of the individual keys;

whereby, when the individual keys are selectively depressed, the sound-generating circuit sounds the scale or melody and the tone-indicating characterful figures are caused to float in the corresponding transparent cylinders.

Preferably, the air feeding means is a blower rotated by drive power of a motor, and air is fed under pressure into a blower pipe from the blower; air feeding ports are formed corresponding to the respective transparent cylinders through a wall of the blower pipe and are selectively opened responsive to depression of the individual keys, whereby the tone-indicating characterful figures are caused to float within the corresponding transparent cylinders; and the transparent cylinders define in top portions thereof openings to discharge the compressed air therethrough. The educational toy keyboard may further comprise a rocking shaft arranged for rocking motion via a cam mechanism by the motor, and a characterful conductor figure mounted on the rocking shaft so that the characterful conductor figure is rockable.

It is desired that the transparent cylinders have heights corresponding to the heights of the corresponding tones and also that the tone-indicating characterful figures are arranged for flotation to top portions of the transparent cylinders in response to depression of the corresponding keys. The tone-indicating characterful figures can therefore visually indicate the scale.

According to the present invention, the educational toy keyboard is constructed to visually indicate the scale by tone-indicating characterful figures which are caused to float in the corresponding transparent cylinders in response to selective depression of the keys. The educational toy keyboard can also play the melody selectively. The educational toy keyboard according to the present invention can therefore attract an infant's interests. It is accordingly very effective as an educational toy keyboard which can arouse an infant's interests in the scale and melodies.

DETAILED DESCRIPTION OF THE INVENTION AND PREFERRED EMBODIMENT

Figure 1:
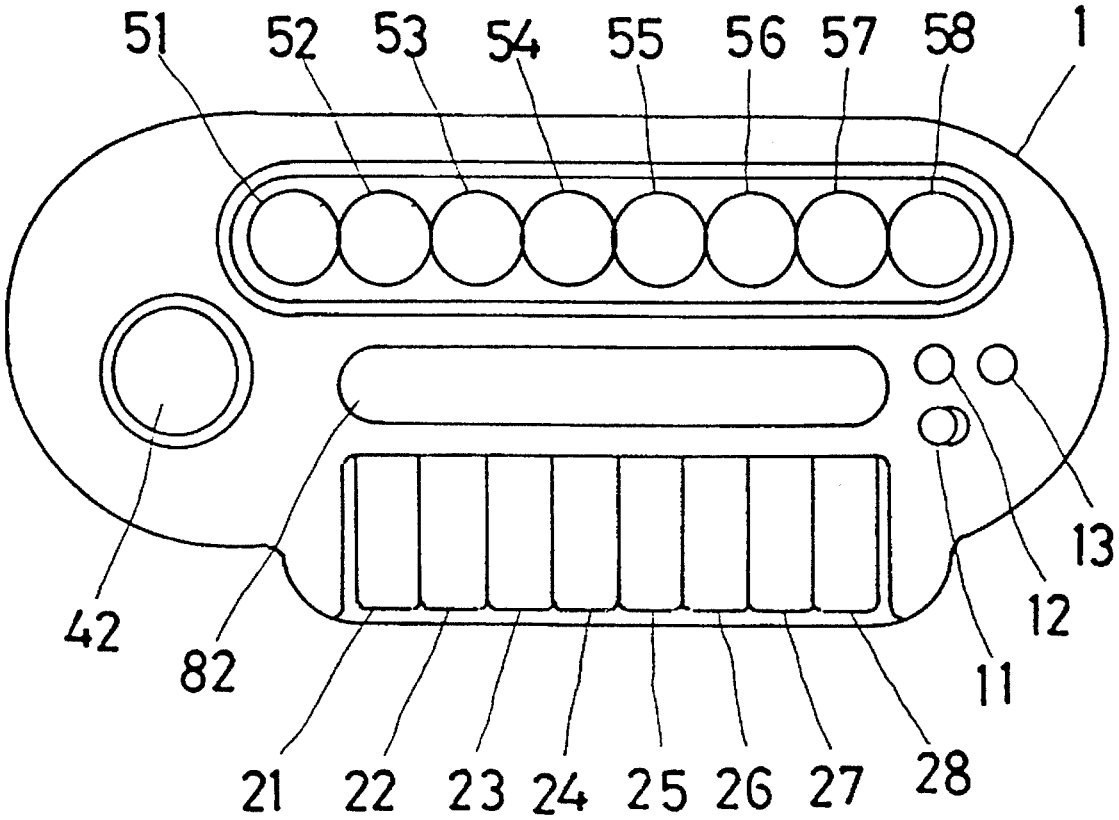
FIG. 1 is a plan view of an educational toy keyboard according to an embodiment of the present invention.
Figure 2:
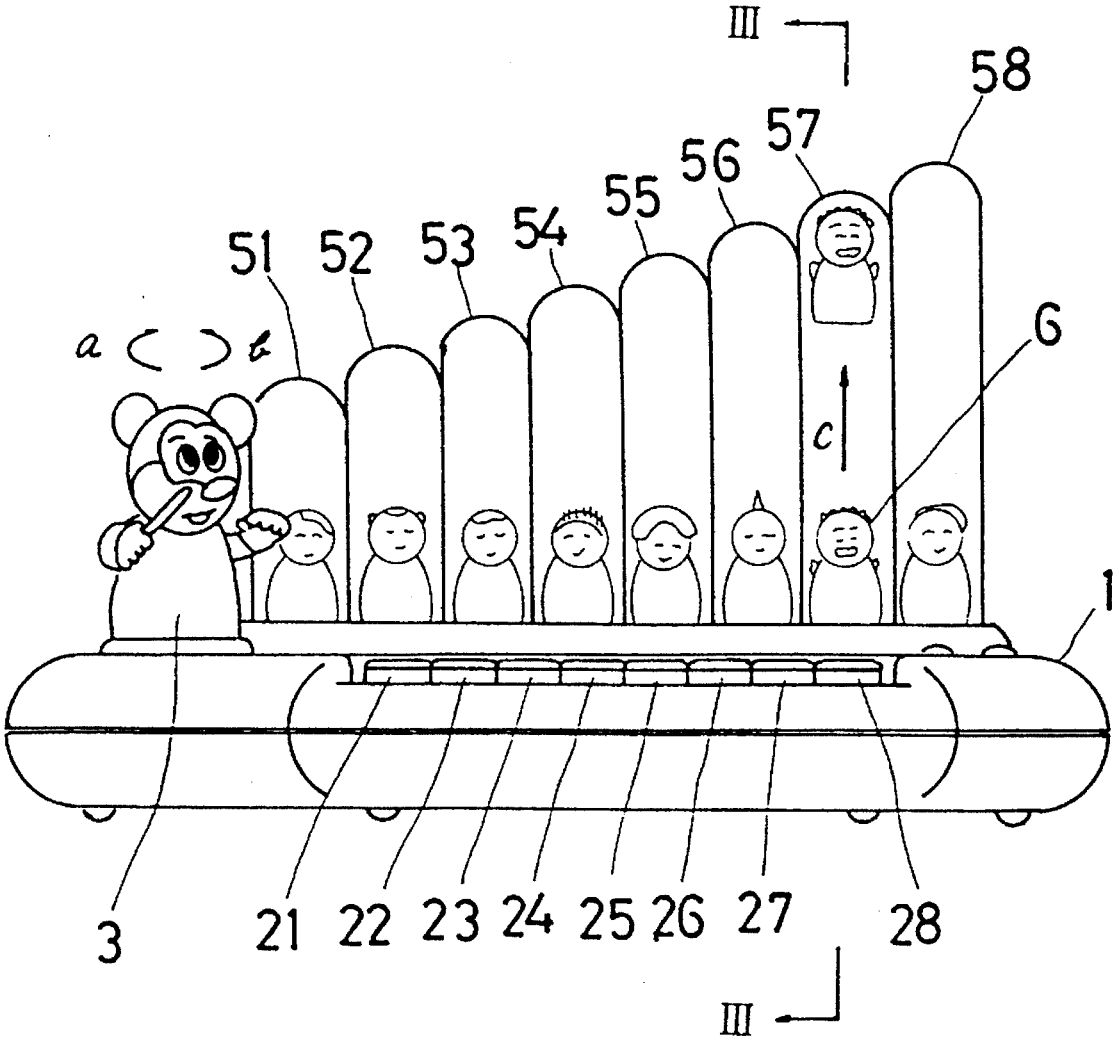
FIG. 2 is a front view of the educational toy keyboard.

The educational toy keyboard according to the embodiment of the present invention will hereinafter be described specifically with reference to the accompanying drawings.

Keys 21–28 and transparent cylinders 51–58, which correspond to the keys 21–28, respectively, are arranged on a toy main body 1. Tone-indicating characterful dolls 6 are fitted in the respectively transparent cylinders 51–58 so that the tone-indicating characterful dolls 6 can be caused to float by buoyancy of compressed air.

By turning on a main switch 11, power is applied from a power supply (not illustrated) so that the educational toy keyboard becomes ready to play. Selection of either a scale switch 12 or a melody switch 13 makes it possible to selectively sound either a tone or a melody when any of the keys 21–28 is depressed.

When any of the keys 21–28 is depressed, a switch 81 for a sound-generating circuit 8 is turned on so that a tone or a melody can be sounded with a speaker 82 via the sound-generating circuit. At the same time, the corresponding tone-indicating characterful doll 6 is caused to ascend and float by compressed air in the corresponding one of the transparent cylinders 51–58.

Described more specifically, the toy main body 1 is provided with a motor 4 and a blower 43 rotated by drive power of the motor 4. By the blower 43, air is inducted through an opening 14 formed in a bottom wall of the toy main body 1. This air is then fed under pressure into a blower pipe 9. When the key 27, for example, is depressed, a key-supporting arm 271 is turned downwardly or counterclockwise about a bead arranged on a top of an upright strip 7. A valve element portion 272 formed of an end portion of the key-supporting arm 271, said end portion being located opposite to the key 27, is thus lifted as indicated by dashed lines, whereby the blower pipe 9 is communicated with the corresponding transparent cylinder 57 via an associated air-feeding port 91 formed through a wall of the blower pipe 9. As a result, the compressed air is fed into the transparent cylinder 57 through the air-feeding port 91. By the pressure of the compressed air, the tone-indicating characterful doll 6 is caused to ascend and float in the transparent cylinder 57. In response to depression of any one of the keys 21–28, the corresponding air-feeding port 91 formed through the wall of the blower pipe 9 is therefore opened so that the corresponding tone-indicating characterful doll 6 is caused to ascend and float in the associated one of the transparent cylinders 51–58. The air so fed under pressure is then allowed to flow out of the transparent cylinder through an opening 571 formed in a top portion of the transparent cylinder.

The heights of the transparent cylinders 51–58 are set corresponding to the heights of their tones. Each tone-indicating characterful doll 6, which is caused to ascend and float to the top portion of the associated one of the transparent cylinders 51–58 in response to depression of the corresponding one of the keys 21–28, can therefore visually indicate the corresponding tone.

Figure 3:
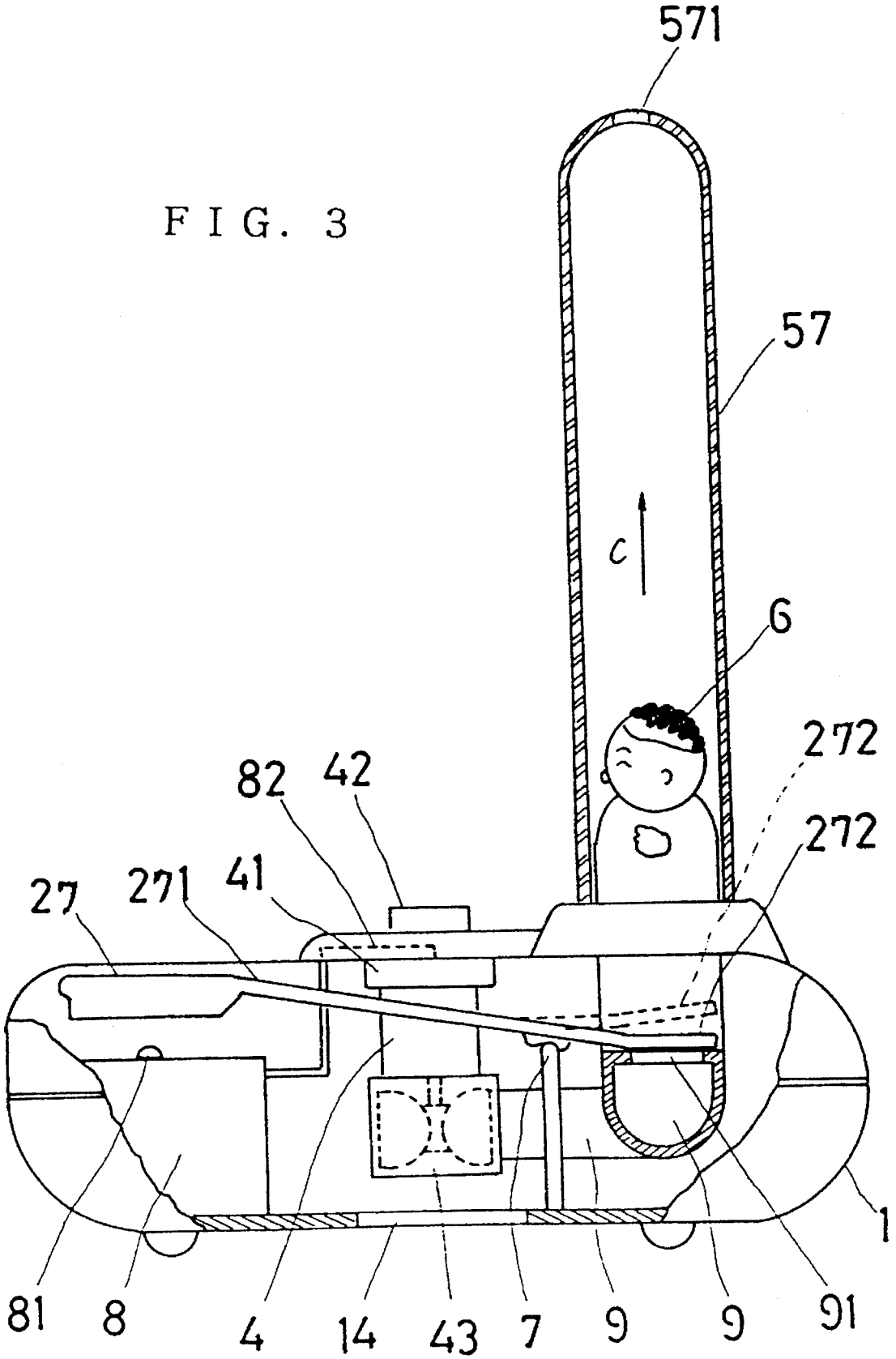
FIG. 3 is a cross-sectional view of the educational toy keyboard taken in the direction of arrows III—III of FIG. 2.

Further, a rocking shaft 42 is arranged for rocking motion via a cam mechanism 41 by the motor 4. A characterful conductor FIG. 3 is fitted on the rocking shaft 42 so that the characterful conductor FIG. 3 is rockable. The characterful conductor FIG. 3 therefore rocks as if the characterful conductor FIG. 3 is conducting a band to play a melody. The characterful conductor FIG. 3 can therefore attract the infant's attention.

What is claimed is:

1. An educational toy keyboard comprising:

a main body;

keys arranged on said main body;

transparent cylinders corresponding to said keys, said transparent cylinders being mounted on said main body;

tone-indicating characterful figures fitted for flotation within the respective cylinders, said tone-indicating characterful figures being floated by buoyancy of compressed air;

feeding means for feeding the compressed air; and a sound-generating circuit capable of sounding a scale or melody in response to depression of the individual keys;

wherein a depression of one of said keys substantially simultaneously causes the sound-generating circuit to sound the scale or melody and permits the feeding means to feed compressed air to a corresponding one of said transparent cylinders so as to cause the tone-indicating characterful figures to float in the corresponding transparent cylinders.

2. An educational toy keyboard comprising:

a main body;

keys arranged on the main body;

transparent cylinders corresponding to the individual keys, said transparent cylinders being mounted on the main body;

tone-indicating characterful figures fitted for flotation within the respective cylinders, said tone-indicating characterful figures being floated by buoyancy of compressed air;

means for feeding the compressed air; and a sound-generating circuit capable of sounding a scale or melody in response to depression of the individual keys;

whereby, when the individual keys are selectively depressed, the sound-generating circuit sounds the scale or melody and the tone-indicating characterful figures are cause to float in the corresponding transparent cylinders;

said air feeding means being a blower rotated by drive power of a motor, and air is fed under pressure into a blower pipe from the blower: air feeding ports are formed corresponding to the respective transparent cylinders through a wall of the blower pipe and are selectively opened responsive to depression of the individual keys, whereby the tone-indicating characterful figures are caused to float within the corresponding transparent cylinders; and the transparent cylinders define in top portions thereof openings to discharge the compressed air therethrough;

said educational toy keyboard further comprising:

a rocking shaft arranged for rocking motion via a cam mechanism by the motor; and a characterful conductor figure mounted on the rocking shaft so that the characterful conductor figure is rockable.

3. An educational toy keyboard according to claim 1, wherein the transparent cylinders have heights corresponding to heights of the corresponding tones and the tone-indicating characterful figures are arranged for flotation to top portions of the transparent cylinders in response to depression of the corresponding keys, whereby the tone-indicating characterful figures can visually indicate the scale.

4. An educational toy keyboard comprising:

a main body;

keys arranged on said main body;

transparent cylinders corresponding to each of said keys, said transparent cylinders being mounted on said main body;

tone-indicating characterful figures fitted for flotation within the respective cylinders, said tone-indicating characterful figures being floated by buoyancy of compressed air;

feeding means for feeding the compressed air into each of said transparent cylinders, said feeding means comprising air feeding ports which correspond to each of said transparent cylinders through which the compressed air is fed into the transparent cylinders; and a sound-generating circuit capable of sounding a scale or melody in response to a depression of the individual keys;

wherein each of said keys are rotatably arranged on said main body such that in a first position of said key a first end of said key is spaced from a switch for actuating said sound-generating circuit and a second end of said key closes said air feeding port, and a depression of said key causes a rotation of said key to a second position in which said first end of said key abuts against said switch of said sound-generating circuit to sound a scale or melody and said second end of said key is spaced from said air feeding port to open said air feeding port and permit compressed air to enter the transparent cylinder and float the tone-indicating characterful figure.

* * * * *